US008720143B2

(12) United States Patent
Noutsis

(10) Patent No.: US 8,720,143 B2
(45) Date of Patent: May 13, 2014

(54) TILE SPACER

(76) Inventor: Photios Noutsis, Farmingville, NY (US)

( * ) Notice: Subject to any disclaimer, the term of this patent is extended or adjusted under 35 U.S.C. 154(b) by 0 days.

(21) Appl. No.: 13/365,346

(22) Filed: Feb. 3, 2012

(65) Prior Publication Data

US 2012/0198789 A1 Aug. 9, 2012

Related U.S. Application Data

(60) Provisional application No. 61/439,071, filed on Feb. 3, 2011.

(51) Int. Cl.
*E04F 13/08* (2006.01)

(52) U.S. Cl.
CPC ..... *E04F 13/0832* (2013.01)
USPC ..... 52/389; 52/747.11; 33/533

(58) Field of Classification Search
USPC ..... 52/389, 396.1, 384, 747.11, 677, 686, 52/689; 33/526, 527, 533, 613, 645, 562
See application file for complete search history.

(56) References Cited

U.S. PATENT DOCUMENTS

| | | | | | |
|---|---|---|---|---|---|
| 1,674,476 | A | * | 6/1928 | Mathews | 52/686 |
| 2,031,684 | A | | 2/1936 | Berger | |
| 2,930,135 | A | * | 3/1960 | Rodtz, Sr. | 33/518 |
| 2,940,264 | A | | 6/1960 | Harper at al. | |
| 3,745,735 | A | * | 7/1973 | Casano | 52/390 |
| 4,793,068 | A | | 12/1988 | Golkar | |
| 4,862,668 | A | | 9/1989 | DeGooyer | |
| 4,953,341 | A | | 9/1990 | Joos | |
| 5,010,654 | A | | 4/1991 | Funes, Jr. | |
| 5,201,130 | A | * | 4/1993 | Krchnak | 33/526 |
| D337,247 | S | | 7/1993 | Dart | |
| 5,288,534 | A | | 2/1994 | Tavshanjian | |
| 5,359,783 | A | | 11/1994 | Smith | |
| 5,363,560 | A | | 11/1994 | Makow | |
| 5,623,799 | A | * | 4/1997 | Kowalski et al. | 52/392 |
| 6,354,058 | B1 | | 3/2002 | Lewis | |
| 6,612,045 | B2 | | 9/2003 | Kruskamp | |
| D492,210 | S | | 6/2004 | Shilo et al. | |
| 6,754,972 | B2 | * | 6/2004 | Donnellan | 33/526 |
| 6,769,191 | B1 | | 8/2004 | Zusman | |
| 6,823,640 | B1 | | 11/2004 | Pytlewski | |
| 6,874,242 | B2 | | 4/2005 | Shilo et al. | |
| 7,257,926 | B1 | | 8/2007 | Kirby et al. | |
| 7,475,488 | B2 | | 1/2009 | Symington | |
| 7,516,558 | B2 | | 4/2009 | Frank et al. | |
| 7,536,802 | B1 | | 5/2009 | Tavy et al. | |
| 7,650,700 | B1 | | 1/2010 | Blankenship | |
| 7,698,831 | B2 | * | 4/2010 | Higgs et al. | 33/526 |
| 7,941,987 | B1 | | 5/2011 | Raim | |
| 7,946,093 | B1 | | 5/2011 | Sturino | |
| 8,099,926 | B2 | * | 1/2012 | Kufner et al. | 52/749.11 |
| D665,657 | S | * | 8/2012 | Pelc | D8/382 |
| 2003/0226271 | A1 | | 12/2003 | Cordell | |
| 2004/0250435 | A1 | | 12/2004 | Fiore | |
| 2005/0214502 | A1 | | 9/2005 | Westthorp | |

(Continued)

*Primary Examiner* — William Gilbert
*Assistant Examiner* — Gisele Ford
(74) *Attorney, Agent, or Firm* — Carter, Deluca, Farrell & Schmidt, LLP

(57) ABSTRACT

In an embodiment, a tile spacer for providing spacing between adjacent tiles during installation on an installation surface includes a body portion defining a substantially planar surface, a flange portion extending outward from the body portion along the planar surface and at least one arm member extending from the flange portion substantially perpendicular to the planar surface and configured for insertion between adjacent tiles

8 Claims, 3 Drawing Sheets

(56) References Cited

U.S. PATENT DOCUMENTS

| | | | | |
|---|---|---|---|---|
| 2005/0257468 | A1 | 11/2005 | Serros et al. | |
| 2007/0214743 | A1 | 9/2007 | Alvarez | |
| 2007/0227025 | A1 | 10/2007 | Venture | |
| 2009/0260317 | A1 | 10/2009 | Burns et al. | |
| 2010/0088912 | A1 | 4/2010 | Higgs et al. | |
| 2011/0113722 | A1 | 5/2011 | Dvorak | |
| 2011/0146200 | A1 | 6/2011 | Dang | |
| 2011/0179728 | A1 * | 7/2011 | Cerny et al. | 52/177 |

* cited by examiner

TILE SPACER

CROSS-REFERENCE TO RELATED APPLICATIONS

This application claims the benefit of U.S. Provisional Patent Application Ser. No. 61/439,071, filed Feb. 3, 2011 by the present inventor, the entire contents of which are incorporated herein by reference.

BACKGROUND

1. Technical Field

The present disclosure relates to a tile spacer configured for placement between tiles so that the tiles are equally spaced and lined up during installation.

2. Description of Related Art

Tiles are generally provided in a uniform shape for a tiling project, typically a rectangular or square shape. During tile laying, tiles are usually placed in a grid pattern with adjacent tiles being spaced apart by a set or uniform distance. Once the tiles have been positioned, grout and/or glue is used to affix each tile to an installation surface and the spaces between adjacent tiles are filled in with grout. It is especially difficult to position tiles properly when working on a wall or other surface since the tiles may move or slide while gluing/affixing due to the force of gravity. This is a problem because when tiles are not uniformly spaced, the final product, e.g., the look of the tile wall, is degraded and is not aesthetically pleasing to the end user.

Flat plastic or wood cross-shaped spacers have been used in the tiling industry to provide equal spacing between tiles. Typically, after the first tile is laid, a cross-shaped spacer is positioned at each corner of the tile and adjacent tiles are then laid against the cross-shaped spacer. Each arm of the cross-shaped spacer provides spacing between adjacent tiles while the center of the cross-shaped spacer provides spacing between diagonally disposed tiles. In this way, four tiles may be positioned together to form a grid with substantially uniform spacing therebetween. Unfortunately, the thickness of the plastic or wood cross-shaped spacers is usually smaller than that of the tiles being used which makes it hard to remove the spacers after the tile has been glued in place. When a spacer cannot be removed, a contractor or other tile layer often leaves the spacer in place and covers the spacer with grout. This can cause cracks in the grout because the grout does not adhere to the spacers. In addition, when a spacer is used on a wall it is more likely to get stuck between the tiles since the upper tiles will press against the spacer due to gravity. If a spacer is unable to be removed from a side wall or ceiling the resultant cracking may cause the tiles to more easily fall off the wall which may be a hazard to a user of the tiled room. Thus, the ability to remove a spacer from the tile after affixing the tile to a surface is another problem in the tiling industry.

A number of different tile spacers have been developed to overcome these problems. Some tile spacers have a handle attached to a spacer and some have increased height so that the spacer can extend past the surface of tiles for removal. However, these attempts do not effectively solve the problem of tiling on side walls or ceilings because, by placing tile spacers in between tiles, tiles on a wall are neither securely lined up nor attached to the wall due to gravity.

SUMMARY OF THE PRESENT DISCLOSURE

Disclosed herein is a tile spacer for providing spacing between adjacent tiles during installation of tiles on an installation surface.

In an embodiment, a tile spacer for providing spacing between adjacent tiles during installation on an installation surface includes a body portion defining a substantially planar surface, a flange portion extending outward from the body portion along the planar surface and at least one arm member extending from the flange portion substantially perpendicular to the planar surface and configured for insertion between adjacent tiles.

In an aspect of the present disclosure, the arm member includes a tapered portion ending in a tip.

In an aspect of the present disclosure, the body portion of the tile spacer includes a hole extending therethrough transverse to the planar surface. The hole of the body portion may be disposed in the center of the body portion and the tile spacer may further include a retaining mechanism configured for insertion through the hole of the body portion to engage the installation surface where the retaining mechanism is be configured to secure the tile spacer to the installation surface.

In an aspect of the present disclosure, the tile spacer is formed of a metal or a plastic.

In an aspect of the present disclosure, the tile spacer includes four arm members and each arm member may be radially offset from an adjacent arm member by ninety degrees.

In an embodiment of the present disclosure, a method of manufacturing a tile spacer is disclosed, including the steps of: providing a body portion, partially cutting the body portion at approximately one third of its width to create a flange portion and an arm member and bending the arm member until the arm member is substantially perpendicular to the flange portion and the body portion.

In an aspect of the present disclosure, the steps of partially cutting and bending are repeated on the body portion offset by ninety degrees to form three additional flange portions and three additional arm members.

In an aspect of the present disclosure, the step of providing a body portion includes providing a body portion from the group consisting of a square body portion and a circular body portion.

In an aspect of the present disclosure, the body portion includes a hole extending therethrough.

In an embodiment of the present disclosure, a method of spacing tile during installation on an installation surface is disclosed, the method including the steps of: providing a tile spacer, applying a tile to an installation surface adjacent at least one other tile and inserting at least one arm member of the tile spacer between the tile and the at least one other tile to form a space between the tile and the at least one other tile, a body portion of the tile spacer remaining outside of the space between the tile and the at least one other tile.

In an aspect of the present disclosure, the method further includes the step of inserting a retaining member through a hole of the body portion of the tile spacer to engage the installation surface. The retaining member is configured to engage the body portion to secure the tile spacer against the tile and the at least one other tile to secure the tile and the at least one tile against the installation surface.

In an aspect of the present disclosure, the method further includes the step of removing the tile spacer from between the tile and the at least one other tile after the tile and the at least one other tile have been affixed to the installation surface.

In an aspect of the present disclosure, the tile is applied to the installation surface with a glue.

In an aspect of the present disclosure, the step of providing a tile spacer includes providing set of tile spacers, each tile spacer having arm members with a different thickness.

Any of the above embodiments and aspects of the present disclosure described may be combined with any other embodiment and aspect of the present disclosure without departing from the scope of the present disclosure.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
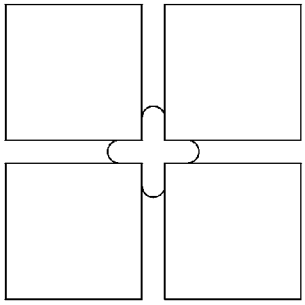
FIG. 1 (Prior Art)
FIG. 1 is a prior art tile spacer.

Embodiments of the present disclosure will now be described in detail with reference to the drawings in which like reference numerals designate identical or corresponding elements in each of the several views.

Figure 2B:
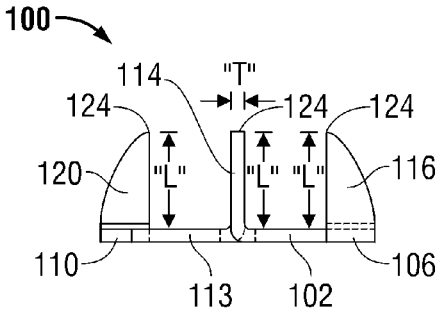
FIG. 2B is a side view of the tile spacer of FIG. 2.
Figure 2A:
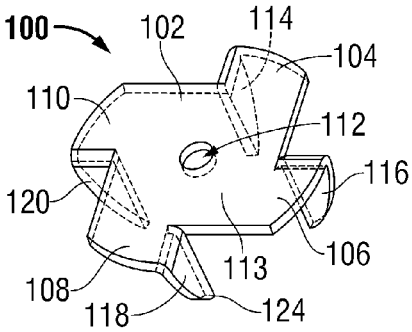
FIG. 2A is a perspective view of a tile spacer according to the present disclosure.
Figure 2C:
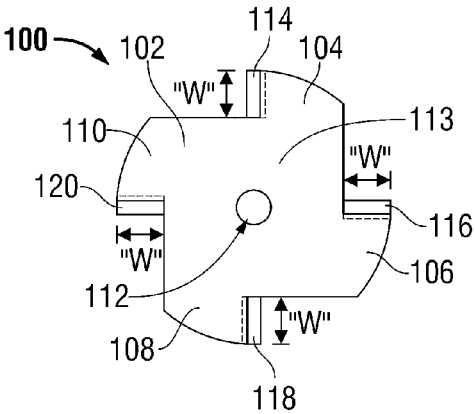
FIG. 2C is a top down view of the tile spacer of FIG. 2.

With reference now to FIGS. 2A-2D, a tile spacer for providing spacing between adjacent tiles during tile laying in accordance with the present disclosure is illustrated and is generally referred to by reference 100. Tile spacer 100 includes a body portion 102 having four flanged portions 104, 106, 108, 110 extending therefrom and a hole 112 extending therethrough. Body portion 102 defines a planar surface 113 having substantially square shape with each flanged portion 104, 106, 108, 110 extending from a side of the square along the planar surface. It is contemplated that body 102 may define other shapes including, for example, circular shapes, rectangular shapes, or other similar geometric shapes. As illustrated in FIG. 2C, flanged portions 104, 106, 108, 110 extend a uniform distance "W" from body portion 102, for example, ⅓" or ¼". It is contemplated that tile spacers 100 including flanged portions 104, 106, 108, 110 that extend larger or smaller distances "W" from body portion 102 may also be provided.

Figure 2D:
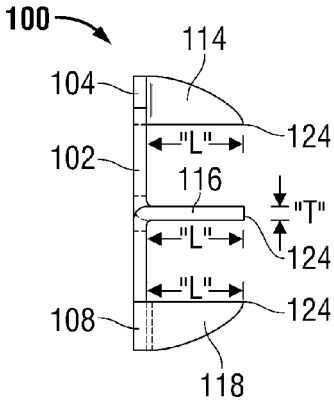
FIG. 2D is a side view of the tile spacer of FIG. 2, rotated 90 degrees from the side view of FIG. 2B.
Figure 4:
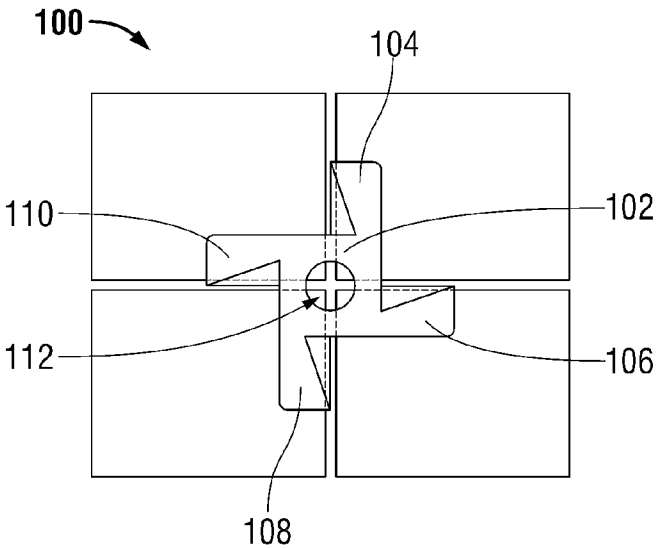
FIG. 4 is a top down view of the tile spacer of FIG. 2A inserted in between tiles.

Arm members 114, 116, 118, 120 extend from respective flange portions 104, 106, 108, 110 at a substantially perpendicular angle and are configured for insertion between adjacent tiles during use to provide spacing between adjacent tiles. As illustrated in FIGS. 2B and 2D, to create uniform spacing between adjacent tiles, arm members 114, 116, 118, 120 define a substantially uniform thickness "T", for example, ½". It is contemplated that additional or alternative tile spacers 100 may be provided which include arm members 114, 116, 118, 120 having a larger or a smaller thickness "T". For example, arm members 114, 116, 118, 120 may define a thickness "T" of ½", ⅓", ¼", ⅛", 1/16" or any other thickness used in spacing tiles, as known in the art. It is contemplated that multiple tile spacers 100 having different arm thicknesses "T" may also be provided for use.

As illustrated in FIGS. 2B and 2D, arm members 114, 116, 118, 120 extend from flange portions 104, 106, 108, 110 a uniform length "L" sufficient to allow body portion 102 of tile spacer 100 to be positioned over tiles when arm members 114, 116, 118, 120 are inserted therebetween. Tile spacers 100 having different arm lengths "L" may be provided where, for example, when installing a tile having a ½" height, a tile spacer 100 with ½" or greater arm length "L" may be used such that arm members 114,116, 118, 120 bottom out against the installation surface, e.g., a floor, wall, or ceiling surface, against which the tiles are being affixed.

Figure 3A:
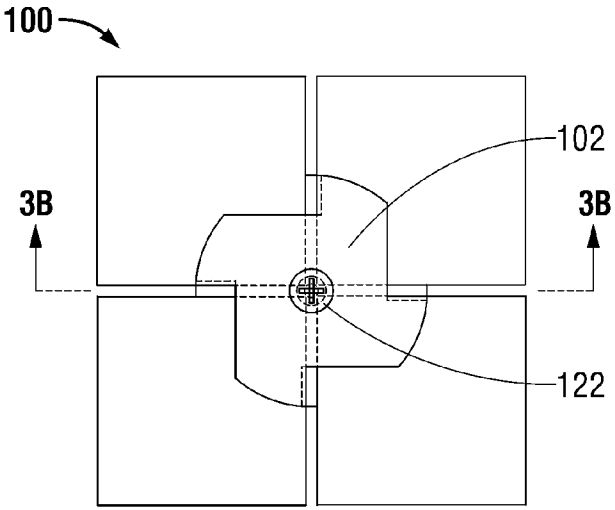
FIG. 3A is a top down view of the tile spacer of FIG. 2A inserted in between tiles with a screw inserted through the opening.
Figure 3B:
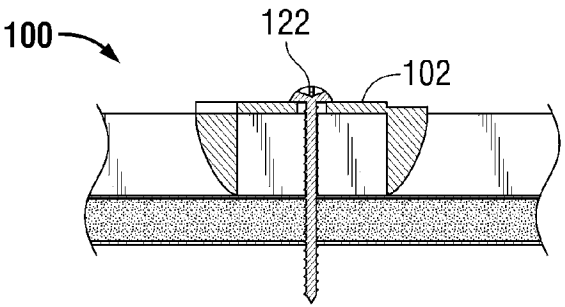
FIG. 3B is a side, cross-sectional view of the tile spacer of FIG. 3A taken along section line 3B-3B.

With reference now to FIGS. 3A and 3B, a retaining mechanism 122, such as, for example, a screw or tack or other similar suitable mechanism, may be inserted through hole 112 of body portion 102 to secure tile spacer 100 against the installation surface and the tiles to hold the tiles in place. Alternatively a shorter arm length "L" may be used such that tile spacer 100 only engages a surface of the tile and does not engage the installation surface with arm members 114, 116, 118, 120.

As illustrated in FIGS. 2A, 2B and 2D, arm members 114, 116, 118, 120 may be tapered toward tips 124. Tips 124 may be pointed or rounded and is configured for engagement with the installation surface. For example, tips 124 may abut the installation surface when tile spacer 100 is positioned between tiles to maintain the position of tile spacer 100 relative to the tiles. In addition, when the retaining mechanism 122 is inserted through the hole 112 of body portion 102 and secured to the installation surface, tips 124 may dig into the installation surface to further secure the tile spacer 100 in place.

Figure 5:
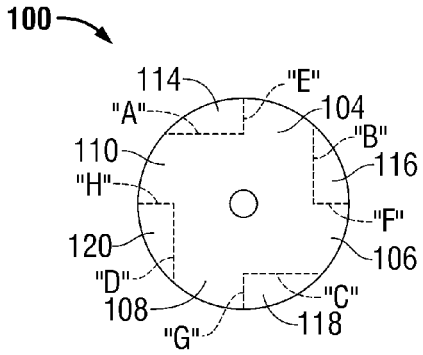
FIG. 5 is a top down view of the tile spacer of FIG. 2A prior to being formed.
Figure 6:
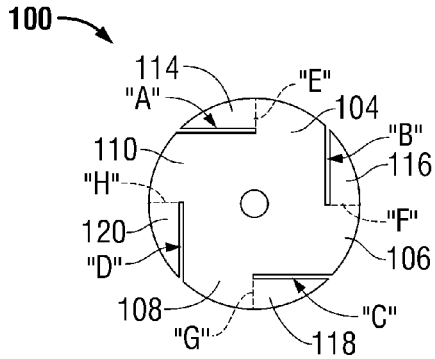
FIG. 6 is a top down view of the tile spacer of FIG. 5 with cuts along lines "A", "B", "C", and "D"
Figure 7:
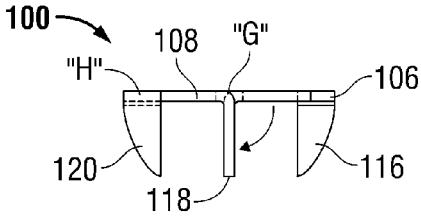
FIG. 7 is a side view of the tile spacer of FIG. 6 with the arm members bent substantially perpendicular to the flanges and the body portion.

With reference now to FIGS. 5-7, the construction of tile spacer 100 will now be described. Tile spacer 100 may be formed of a plastic material, for disposable use, or of a metallic material, for re-use by professionals. Tile spacer 100 may initially be in the form of a circular washer, as illustrated in FIG. 5. As illustrated in FIGS. 5 and 6, four cuts are then made to tile spacer 100 along lines "A", "B", "C", and "D," at approximately ⅓ of the width of tile spacer 100, to form flanges 104, 106, 108, 110 and arm members 114, 116, 118, 120. After cutting tile spacer 100, arm members 114, 116, 118, 120 are bent at lines "E", "F", "G", "H", respectively, substantially perpendicular to flanges 104, 106, 108, 110, as illustrated in FIG. 7. Tile spacer 100 has now been formed and is ready for use. If tile spacer 100 is a plastic material, tile spacer 100 may be formed as known in the art through processes such as, for example, injection molding. It is also contemplated that tile spacer 100 may initially be in the form of a square washer or other geometric shapes.

Figure 8:
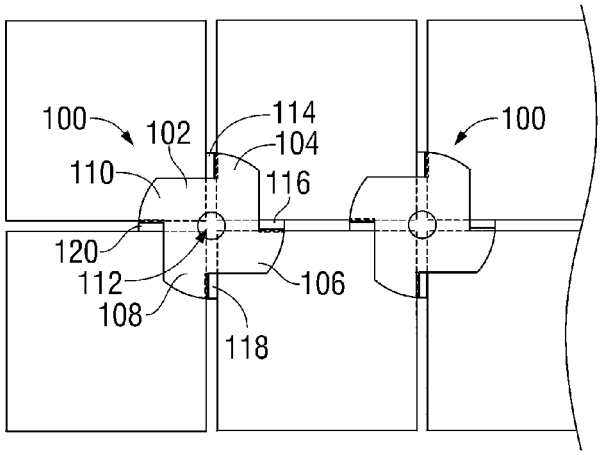
FIG. 8 is a top down view of the tile spacer of FIG. 6 inserted between tiles.

With reference now to FIG. 8, during use, as the user lays tile, the user applies glue or other affixing material to the back of a tile and positions the tile on the installation surface. Tile spacers 100 are then inserted between adjacent tiles at the corners, as illustrated in FIG. 8, with arm members 114, 116, 118, 120 inserted between each adjacent tile such that four tiles form a grid pattern. When working on a wall or ceiling, retaining mechanism 122 is inserted through hole 112 of body portion 102 and tightened to further secure tile spacer 100 and the adjacent tiles in place. For example, as the user lays additional rows of tiles, the corner of each tile will be held in place by a tile spacer 100 and secured to the installation surface so that the glue can cure. Once the glue has cured, tile spacers 100 may be removed and grout is applied to the channel formed between the tiles to further secure the tiles in place and provide an aesthetically pleasing look. It is contemplated that tile spacer 100 may be positioned with body portion 102 against the installation surface and that tiles may be placed on top of tile spacer 100 to provide the necessary spacing. In this case, tile spacer 100 will be left in place during grouting. Tile spacer 100 may be positioned prior to installation of all of the tiles such an additional adjacent tile may be added by inserting a corner of the adjacent tile in between two adjacent arm members 114, 116, 118, 120.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to the precise embodiments described herein, and that various other changes and modifications may be effected by one skilled in the art without departing from the scope or spirit of the present disclosure.

What is claimed is:

1. A tile spacer for providing spacing between adjacent tiles during installation on an installation surface, the tile spacer comprising:

a body portion defining a substantially planar surface;

a flange portion unitary with the body portion, said flange portion extending outward from the body portion along the planar surface and co-planar with the planar surface; and at least one arm member unitary with the flange portion and the body portion, said at least one arm member extending from the flange portion substantially perpendicular to the planar surface and defining a distal end configured for insertion between adjacent tiles, wherein the arm member tapers from the flange portion to the distal end portion.

2. The tile spacer according to claim 1, wherein body portion of the tile spacer includes a hole extending therethrough transverse to the planar surface.

3. The tile spacer according to claim 2, wherein the hole of the body portion is disposed in the center of the body portion.

4. The tile spacer according to claim 2, wherein the tile spacer further includes a retaining mechanism, the retaining mechanism configured for insertion through the hole of the body portion to engage the installation surface, the retaining mechanism configured to secure the tile spacer to the installation surface.

5. The tile spacer according to claim 1, wherein the tile spacer is formed of a metal.

6. The tile spacer according to claim 1, wherein the tile spacer is formed of a plastic.

7. The tile spacer according to claim 1, wherein the tile spacer includes four arm members.

8. The tile spacer according to claim 7, wherein each arm member is radially offset from an adjacent arm member by ninety degrees.

* * * * *